United States Patent [19]

Schwarz

[11] Patent Number: 5,005,776

[45] Date of Patent: Apr. 9, 1991

[54] PROCESS AND DEVICE TO GUIDE AND SEVER A THREAD UPON BOBBIN REPLACEMENT

[75] Inventor: Ralph Schwarz, Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 486,383

[22] Filed: Feb. 28, 1990

Related U.S. Application Data

[63] Continuation-in-part of Ser. No. 174,596, Mar. 29, 1988, abandoned.

[30] Foreign Application Priority Data

Mar. 31, 1987 [DE] Fed. Rep. of Germany ..... 3710692

[51] Int. Cl.[5] ..... B65H 54/02; B65H 54/34

[52] U.S. Cl. ..... 242/18 PW; 242/19

[58] Field of Search ..... 242/18 PW, 18 A, 35.5 A, 242/19

[56] References Cited

U.S. PATENT DOCUMENTS

| | | | |
|---|---|---|---|
| 3,823,884 | 7/1974 | Sartori | 242/18 PW |
| 4,084,760 | 4/1978 | Nakano et al. | 242/18 PW X |
| 4,111,375 | 9/1978 | Dolle | 242/18 PW |
| 4,154,409 | 5/1979 | Reisser et al. | 242/18 PW |
| 4,431,138 | 2/1984 | Schiminski et al. | 242/18 PW X |
| 4,591,105 | 5/1986 | Niederer | 242/18 A |
| 4,634,064 | 1/1987 | Burkhard et al. | 242/18 PW |
| 4,687,148 | 8/1987 | Schuller et al. | 242/18 PW |
| 4,739,940 | 4/1988 | Flueli et al. | 242/18 PW |

*Primary Examiner*—Stanley N. Gilreath

*Attorney, Agent, or Firm*—Dority & Manning

[57] ABSTRACT

A process for replacing a full wound bobbin on a bobbin winding machine with an empty bobbin support, wherein the yarn is wound onto the bobbin support in a bobbin winding zone by a traversing yarn guide. The process includes moving the traversing yarn guide out of the winding zone when the bobbin is completed, and into a cutting and clamping zone for severing the yarn. The yarn continues to be fed by the spinning machine, and will be collected by a suction pipe while the full bobbin is being replaced by an empty support. The suction pipe moves the yarn into a position to be clamped and cut by a cutting and clamping device, which rotates with the support for the bobbin. The yarn is guided to wind a reserve onto the end of the bobbin support before moving the yarn back into the winding zone to be wound by the traversing means onto the empty bobbin support.

The invention also includes a device for carrying out the process of the invention. This device comprises a traversing yarn guide which is detachably connected to the yarn traversing means by a permanent magnet. When the full bobbin is completed, means are provided for detaching the yarn traversing guide from the yarn traversing means, and to move it into the cutting and clamping zone.

18 Claims, 7 Drawing Sheets

PROCESS AND DEVICE TO GUIDE AND SEVER A THREAD UPON BOBBIN REPLACEMENT

RELATED APPLICATION

This application is a continuation-in-part of my application Ser. No. 174,596 filed Mar. 29, 1988 for PROCESS AND DEVICE TO GUIDE AND SEVER A THREAD UPON BOBBIN REPLACEMENT, now abandoned.

BACKGROUND OF THE INVENTION

The instant invention relates to a process for the replacement of full bobbins on a spinning/spooling machine in which the supplied yarn is wound up into a bobbin by means of a traverse yarn guide moving in a bobbin winding zone, and in which it is clamped and cut off in a clamping and cutting zone at the side of, and next to, the bobbin support after the replacement of a full bobbin by an empty bobbin support. The invention further relates to a device to carry out the process.

To carry out bobbin replacement, proposals have been made in the past to reduce the operating speed of the spinning machine, to stop the yarn guide in its left end position and to press an empty bobbin support or tube inserted into a bobbin tube holder, against the winding shaft after ejection of the full bobbin from the bobbin carrier, said bobbin tube or support having first been brought into immediate proximity of the full bobbin by swiveling the bobbin holder (see German Patent Publication DE-OS 2.503.545). The yarn is then pressed by a yarn deflection plate against the left face of the bobbin support where it comes into range of a knife and where it is clamped between the bobbin support plate and the bobbin support or tube as the bobbin carrier closes. The rotation of the bobbin tube finally causes the yarn segment connecting the bobbin tube to the replaced, full bobbin to be severed at the knife.

A disadvantage of this process is that it is unsuitable for high bobbin speeds and is, furthermore, only applicable when all the bobbins of the machine are being replaced at the same time.

According to another known device, the yarn, which is continuously supplied by the device, is cut above the draw-off rollers before bobbin replacement and is introduced into a swiveling nozzle, the swiveling motion of which causes the yarn to reach the gap between the bobbin support and the centering head of the bobbin holder after the replacement of the full bobbin by an empty bobbin tube or support and while the bobbin holder is not yet completely closed (see German Publication DE-OS 2.312.609). At that point, or inside the centering head itself, the yarn is clamped as the bobbin holder closes and is cut by scissors attached at the outlet of the swiveling nozzle. To provide a yarn reserve on the bobbin tube or support, the yarn is held at a distance from the area of the yarn guide by a guiding wire. Once the yarn reserve has been provided next to the actual bobbin winding, the yarn is pressed down by the guide wire so that it can be caught by the traverse yarn guide and can be wound appropriately on the bobbin body.

This handling of the yarn is not suitable for high machine speeds when there is a danger that the yarn might not be caught by the yarn guide.

SUMMARY OF THE INVENTION

It is the object of the instant invention to avoid the disadvantages of the known devices and processes and to create a process and a device to guide and separate a yarn, making it possible to effect replacement of full bobbins even at high bobbin speeds without difficulty.

This object is attained through the invention in that the traverse yarn guide guides the yarn away from the bobbin winding zone to a clamping and cutting zone and thereafter back into the bobbin winding zone.

In order to avoid yarn being sloughed off the bobbin, it is deflected vertically in relation to the bobbin axis as it is transferred into the clamping and cutting zone. The yarn guide places the yarn in front of the inlet of a suction pipe in the clamping and cutting zone, so that the yarn which the spinning device continues to feed can be sucked into and through the suction pipe.

The fact that the yarn guide is being moved back and forth next in the bobbin winding zone makes it possible to wind a yarn reserve without any additional auxiliary means in order to provide a reserve winding of the yarn. The yarn is, preferably, first cut and then clamped following the replacement of the bobbin by an empty bobbin support or tube and the clamping action is advantageously maintained until the yarn reserve has been wound.

The device to carry out the process is characterized in that the yarn guide is removably attached to the yarn guiding rod, and in that it is provided with a displacement means which displaces it together with the yarn it guides towards the cutting and clamping device. An especially easy and rapid uncoupling and displacement of the traverse yarn guide is made possible through the fact that said yarn guide is held in winding position by a permanent magnet installed on the yarn guiding rod. The repositioning of the traverse yarn guide to wind the yarn reserve on the bobbin tube or support is effected in a simple manner by means of a pressure spring.

In an advantageous further embodiment of the device, the displacement means is installed on a threaded spindle which is rotated in one or the other direction by a reversible motor. In a manner that saves space, the cutting and clamping device, together with a bobbin plate, is incorporated into one and the same assembly. The cutting and clamping device is further improved in that it is equipped with a bolt, provided in a bore, into which a snap ring groove is cut and which is positioned transversely to the yarn running direction, with a cutting edge and a clamping edge to delimit the groove. The cutting and clamping edges are disposed one behind the other in the yarn running direction and interact with an edge constituted by the cut into the bore which acts as a counter-element. In this manner a rapid and defined cut and secure clamping of the yarn is achieved. The cutting edge and the clamping edge are suitably opposed to the counter-element in sequence, one after the other.

A suction pipe, pivotably supported in the radial plane of the snap ring groove, makes it possible to suck the yarn away and, furthermore, inserts the yarn into the cutting and clamping device. A yarn deflection fork, pivotably supported in the end zone next to the cutting and clamping device, prevents the yarn windings from sloughing off the bobbin as the yarn guide, together with the yarn, is pushed out of the bobbin winding zone.

BRIEF DESCRIPTION OF THE DRAWINGS

An embodiment of the invention is described below through the drawings in which

FIG. 1A is a front view of the winding head similar to that seen in FIG. 1;

DETAILED DESCRIPTION OF THE DRAWINGS

Figure 1:
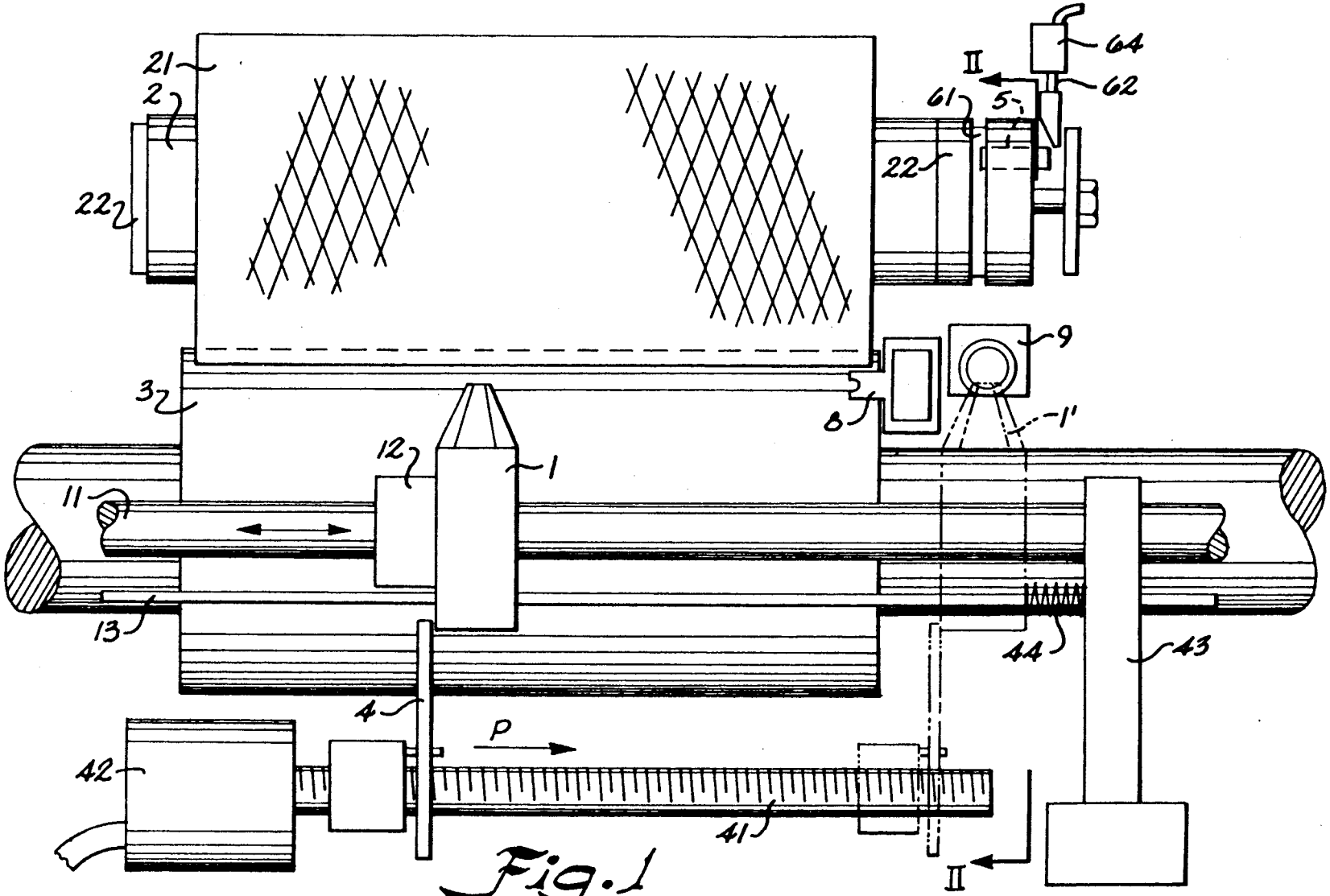
FIG. 1 is a front view of winding head in an embodiment according to the invention.
Figure 14:
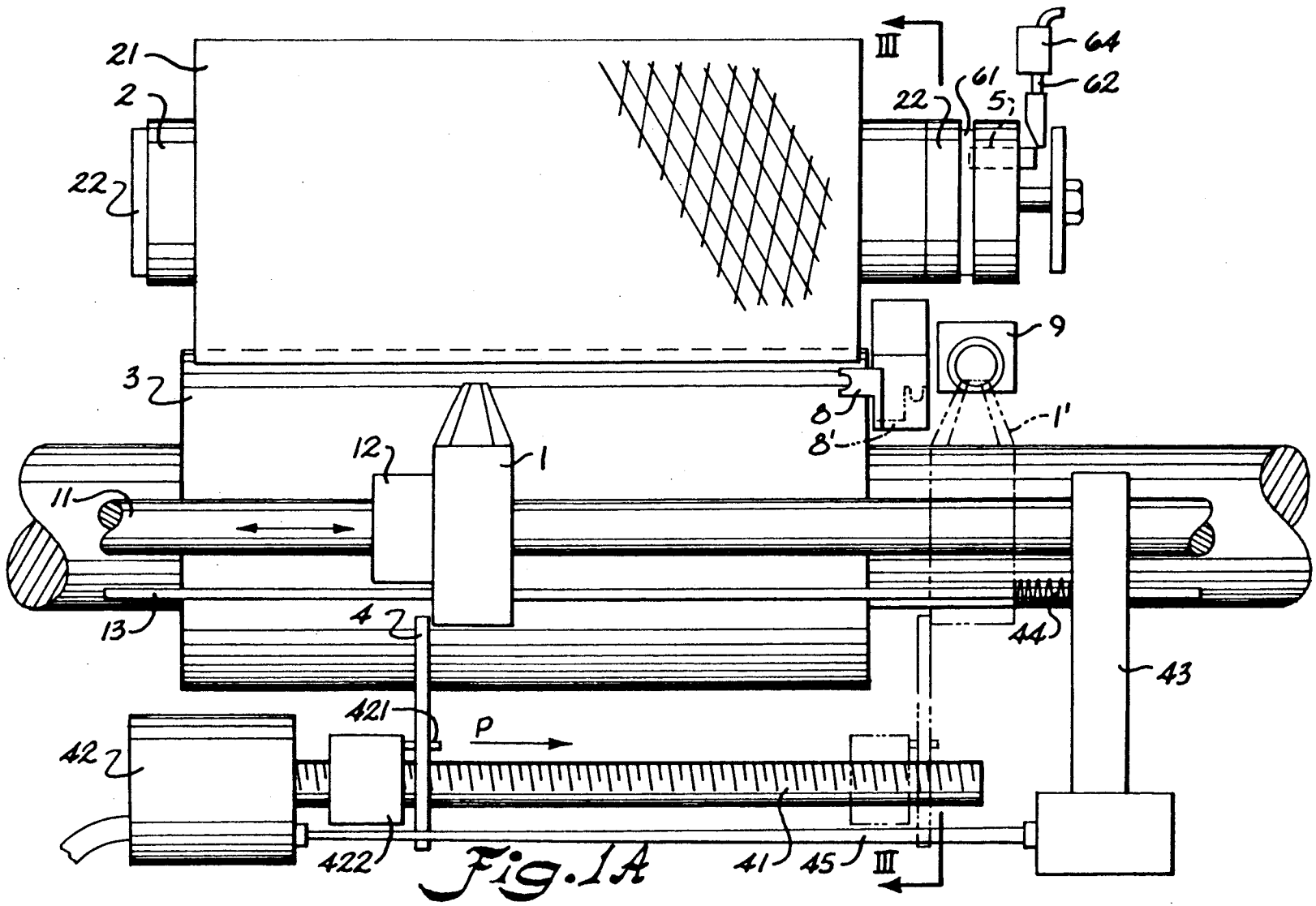

FIG. 1 shows the elements of a winding head in a spinning/winding machine, e.g. an open-end spinning machine, which are essential to the explanation of the invention.

The yarn which is continuously fed by the spinning device is wound up on a bobbin support 2 in a cross-wound manner into a bobbin 21 by means of a traverse yarn guide 1. The bobbin support 2 is held on both sides by a bobbin holder (not shown), on the holding arms of which bobbin plates 22 are rotatably supported, each of which engage the bobbin support ends by means of a centering shoulder. The bobbin support 2 or the bobbin 21 is driven by a drive roll 3 against which it is pressed.

The traverse yarn guide 1 is mounted on a yarn guiding rod 11 which is moved back and forth, parallel to the bobbin support axis in a known manner (and which is, therefore, not shown), as indicated by the double arrow. The yarn guide 1 is shiftably supported on the yarn guiding rod 11, but is held in its position during bobbin formation by a permanent magnet 12 attached on the yarn guiding rod 11. In the fixed position the yarn guide 1 moves within a bobbin zone defined by the length of bobbin 21.

The yarn guide 1 is equipped with a displacement means 4 which is supported on a threaded spindle 41. The threaded spindle 41 is driven by a reversible motor 42. The yarn guide 1 can be shifted on the yarn guiding rod 11, in direction of one bobbin support end and, beyond it, into an end position 1' in a manner to be described in greater detail below. At the same time the yarn guide 1 is prevented by a guiding rod 13 from tilting around the axis of the yarn guiding rod 11 on which said yarn guide 1 slides. The end position 1' is limited by a fixed stop 43 and by a pressure spring 44, both of which are held on the guide rod 13 and are attached to the stop 43.

Figure 2:
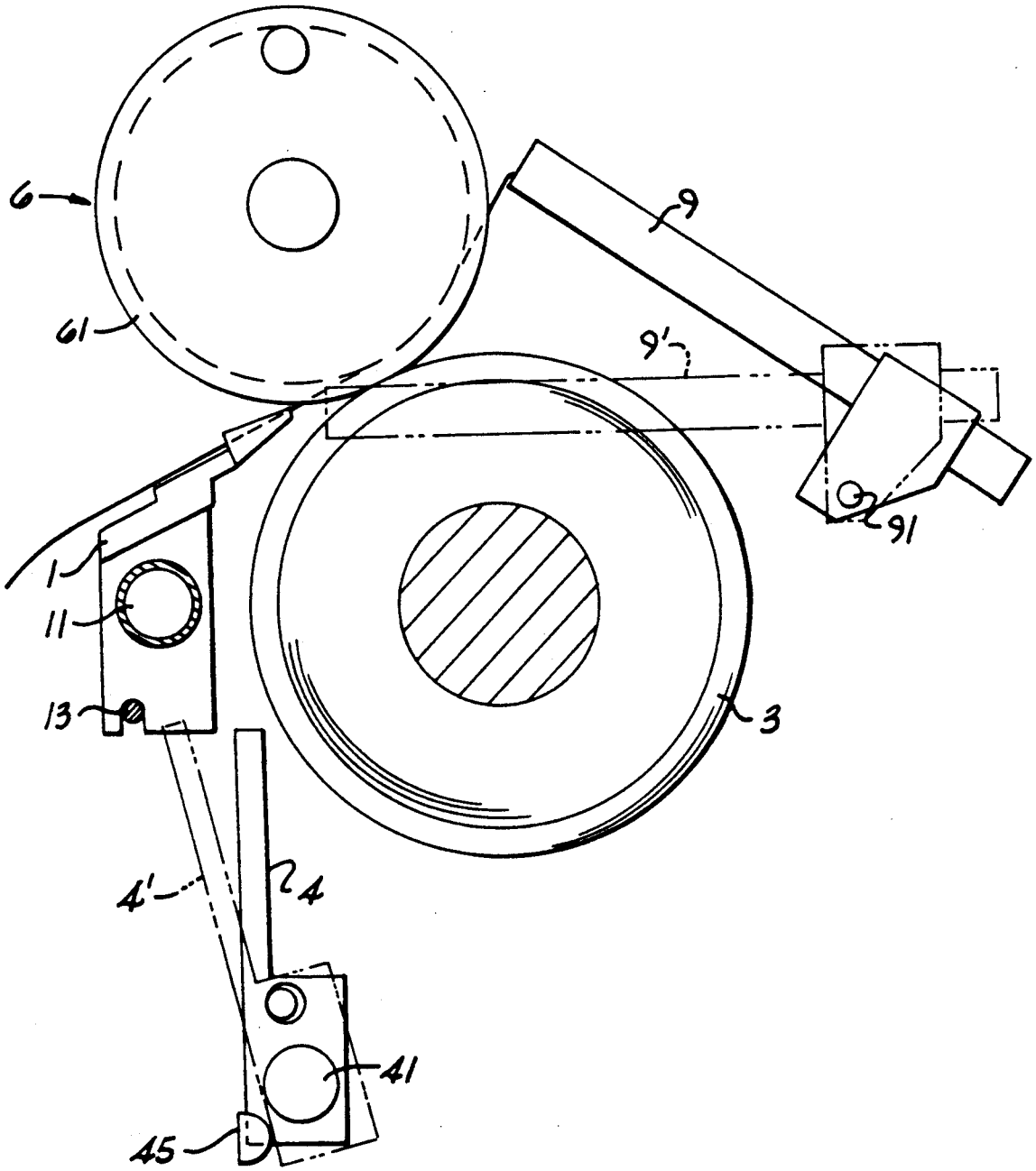
FIG. 2 is a side view of the winding head in FIG. 1.
Figure 2A:
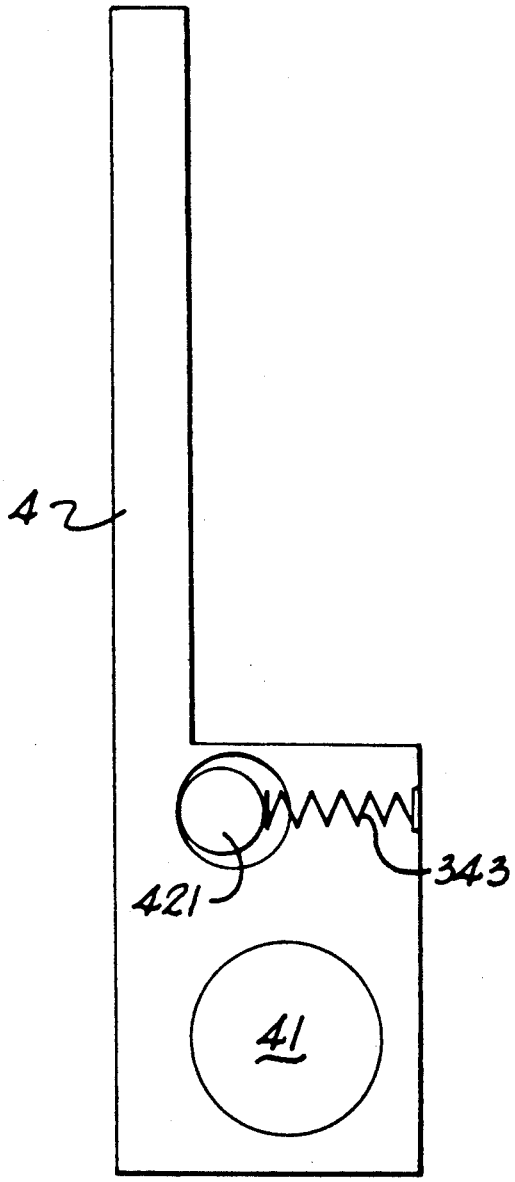
FIG. 2A is an enlarged side view of the displacement means.
Figure 2B:
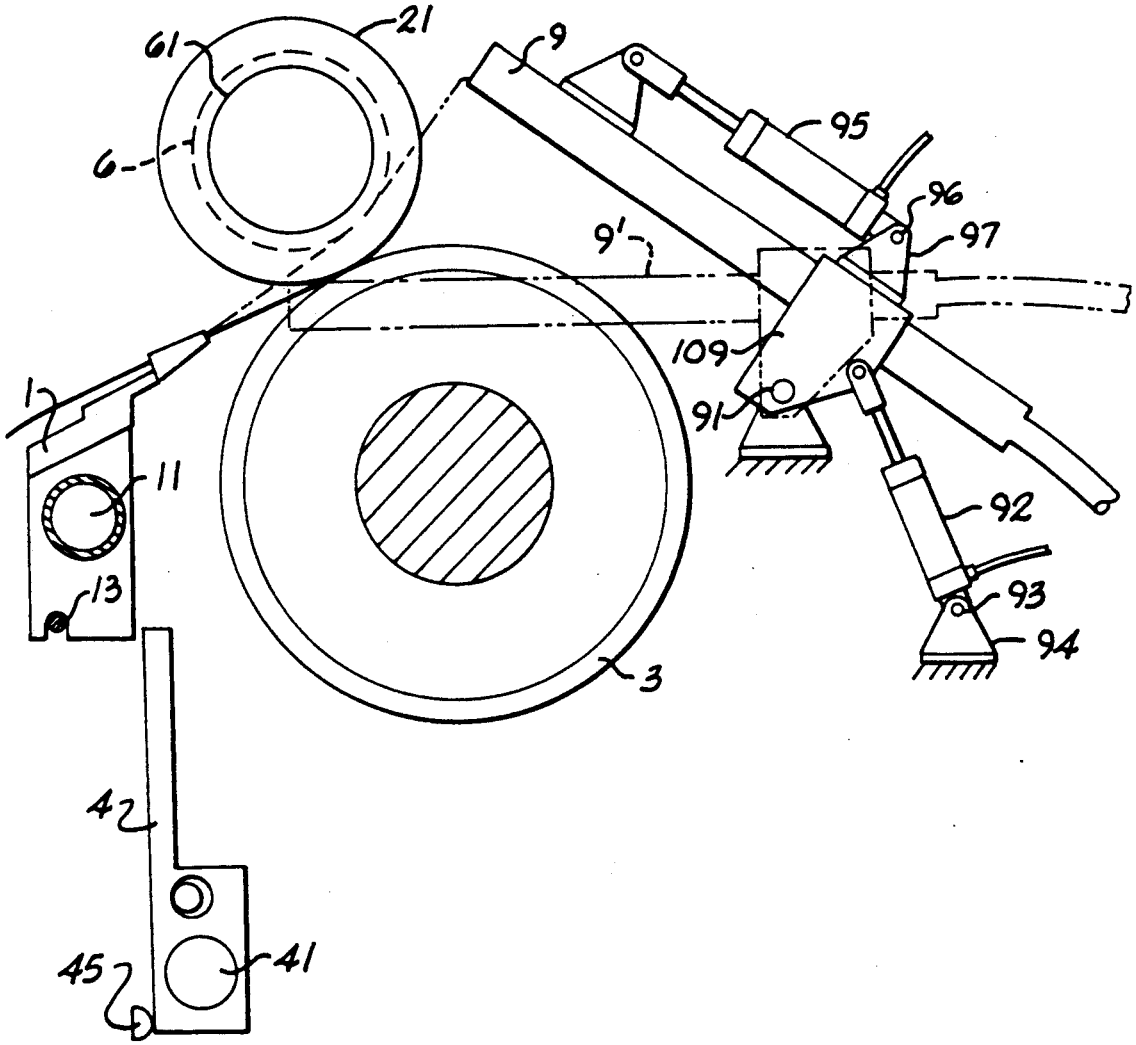
FIG. 2B is a side view of the winding head taken along line II—II of FIG. 1.
Figure 2C:
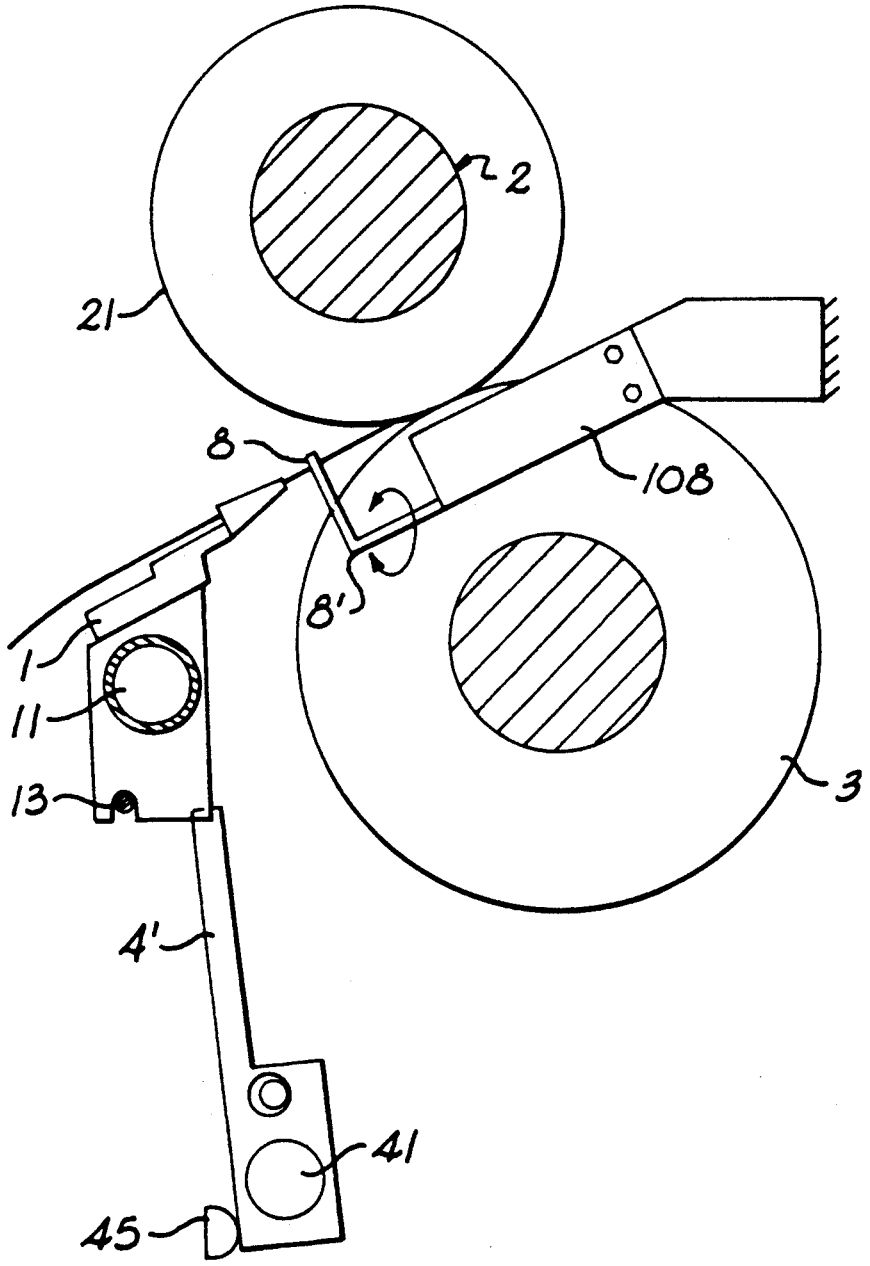
FIG. 2C is a side view of the winding head taken along line III—III of FIG. 1A.

Referring now to FIGS. 1A and 2C, wherein details of fork 8 and the mechanism for operating it is illustrated. Fork 8 is supported for pivoting motion about a pivot point 8' as seen in FIG. 1A and 2C. Yarn guiding fork 8 is pivoted into the path of the yarn by pivoting means 108. Pivoting means 108 may comprise a suitable mechanical crank or the like for pivoting deflection fork 8 90° about axis 8'.

Figure 3:
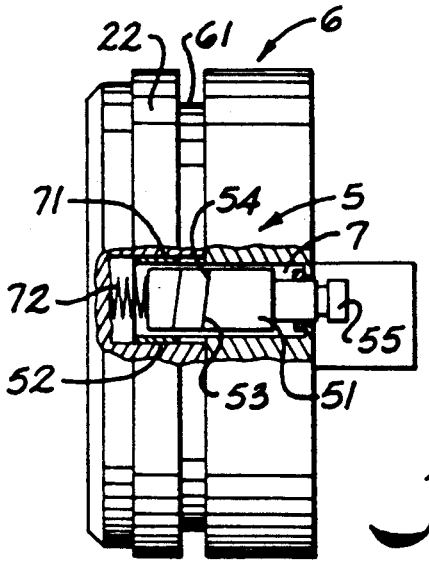
FIG. 3 is a front view, partial in section, of a cutting and clamping device constituting the building assembly with a bobbin plate.

In its end position 1' the yarn guide 1 is located in a zone in which the yarn being continuously fed by the spinning device, is clamped and cut when the full bobbin is replaced. The clamping and cutting device 5, required for this, constitutes one and the same building assembly 6, together with the bobbin plate 22 in the preferred embodiment, and contains a bolt 51 which is supported with little clearance in a bore 7, and a snap ring groove 61 provided in assembly 6 (FIG. 3) being cut into said bore (FIG. 3). Bolt 51 is provided with a groove 52 which is inclined with respect to the snap ring groove 61 in assembly 6 and which is shiftable in the bore, transverse to the yarn running direction.

When bolt 51 is in its starting position, groove 52 and snap ring groove 61 lie in one and the same plane of rotation. Bolt 51 extends with its groove 52 in the radial direction beyond the bottom of snap ring groove 61, so that the arriving yarn can be placed into groove 52. Groove 52 is delimited by a cutting edge 53 and by a clamping edge 54 which are located one behind the other in the yarn running direction. Bolt 51 is capable of being displaced from its starting position, shown in FIG. 3, transverse to the yarn running direction, in the direction of bobbin 21, until cutting edge 53 and clamping edge 54 of groove 52 come into operating contact with the free edge 71 of bore 7 which acts as a counter-element.

Figure 4:
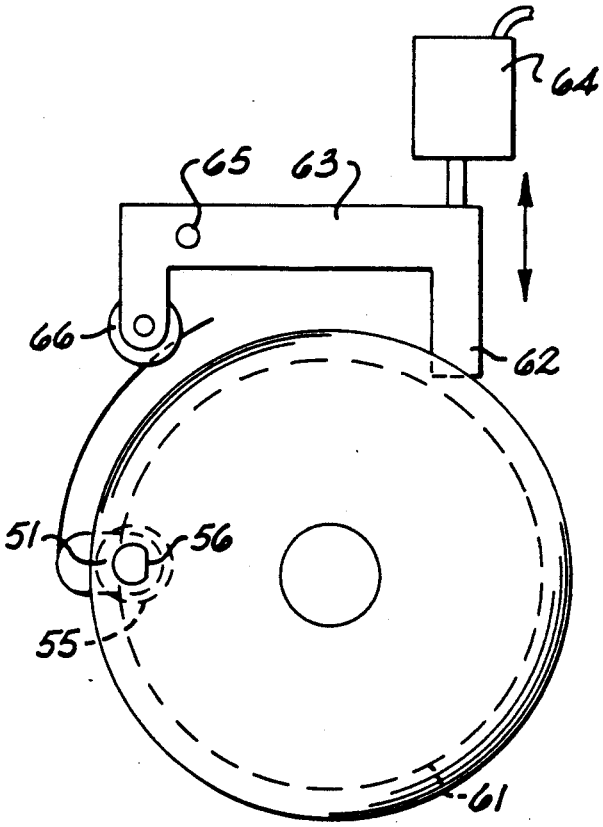
FIG. 4 is a side view of the assembly containing the cutting and clamping device of FIG. 3.

The displacement of bolt 51 is achieved by means of a pressure rod 62 provided with a wedge-shaped end that engages at a projection 55 of bolt 51 extending from the front of assembly 6. A flattened area 56 on projection 55 secures bolt 51 against being twisted (FIG. 4). Pressure rod 62 is located at the end of a two-armed lever 63 which is capable of being swiveled around an axis 65 by means of a double-action lifting electromagnet 64. The other, free end of lever 63 holds a roll 66. The return of bolt 52 to its starting position is effected by means of a pressure spring 72.

The clamping and cutting zone of the yarn further contains a yarn deflection fork 8 and a suction pipe 9 (FIGS. 1A, 2, 2B and 2C). Yarn deflection fork 8 is capable of being swiveled around a swiveling axis 8' which is located near the front of bobbin 21 and is perpendicular to the bobbin support axis from a rest position below the yarn running to bobbin 21 into the path of the running yarn. The suction pipe 9 is capable of being swiveled around an axis 91 which is parallel to the bobbin former axis from an essentially horizontal yarn receiving position 9' below the snap ring groove 61 upwards, into a position behind said snap ring groove 61.

Suction pipe 9 is mounted on bracket 109 for pivoting motion about axis 91. As seen in FIG. 2B, suction pipe 9 is extendable by telescoping into a position for collecting the yarn as seen in the broken line position 9'. A pneumatic cylinder 92 is pivotally connected to bracket 109 on one end, the other end of which is fixed to a bracket 94 for pivoting about axis 93. When cylinder 92 is activated, it causes bracket 109 to pivot in a counterclockwise direction as seen in FIG. 2B. At the same time, a second pneumatic cylinder 95 is pivotally connected to a bracket 97 disposed on the surface of bracket 109 and is mounted for pivoting motion about axis 96. The other end or piston rod of pneumatic cylinder 95 is connected to the outer end of suction pipe 9 and is adapted to cause suction pipe 9 to telescope into the position shown in 9'. For sake of clarity, piston 95 has been omitted from the dotted line position shown when the suction pipe is extended into the position shown in 9'.

FIG. 2A shows details of the support for displacement means 4 on threaded spindle 91. As seen in FIGS. 1A, 2 and 2A, bevel 45 is a rod which is mounted parallel to spindle 41. The diameter of this rod extends in direction of arrow P in FIG. 1A. While displacement means 4 is moving along bevel 45, the displacement means 4 is pivoted from the position 4 to position 4' as seen in FIG. 2. The displacement means 4 is moved back into the position 4 as seen in FIG. 2 by spring 343 which is placed between extension 421 and displacement means 4 when bevel 45 releases it. Extension 421 extends from nut 422 as shown best in FIG. 1A. Furthermore, as seen in FIG. 1A, bevel 45 is a conically shaped rod which gradually increases in diameter as nut 422 traverses screw 41.

The operation of the device proceeds as follows: In the winding operation the traverse yarn guide 1 is coupled to the permanent magnet 12 and is moved back and forth by the yarn guiding rod 11 in the bobbin forming zone. Upon completion of bobbin 21, or after the bobbin has been stopped, upon completion of a maintenance task on a spinning position of one of these bobbin heads, bobbin 21 is lifted sufficiently so that it loses contact with the drive drum 3 and activates the reversible motor 42 which rotates the threaded spindle 41. This causes the displacement means 4 which is swivelled into position 4' by means of a leading bevel 45 (FIGS. 2 and 2A) to be moved in the direction of arrow P towards the fixed stop 43, whereby it pushes the yarn guide 1 away from the permanent magnet 12 and pushes it, together with the yarn remaining in the yarn guide, on guiding rod 11 beyond the end of the bobbin support or tube into position 1' in the yarn clamping and cutting zone. In this position 1' the yarn guide 1 compresses spring 44. Naturally the swing of the displacement means 4 into position 4' occurs when the yarn guide 1 is located in front of the displacement means 4 in relation to the displacement direction P. In order to prevent yarn from being knocked off bobbin 21 during the displacement of the yarn guide 1 beyond the end of the bobbin, the yarn guiding fork 8 is swivelled into the path of the yarn before the beginning of the displacement, or simultaneously with it. The yarn comes to lie in fork 8 and is thus prevented from slipping off bobbin 21.

In end position 1', the yarn guide 1, together with the yarn, is located directly in front of the inlet or mouth of the suction pipe 9 which had been swiveled into position 9'. The yarn, which continues to be fed by the spinning device while bobbin 21 is stopped, is sucked into the suction pipe 9 in the form of a loop and is separated from bobbin 21 by means of a cutting device (not shown) appropriately located inside suction pipe 9. Bobbin 21 is then replaced by an empty bobbin support or tube and the latter is brought into contact with the drive drum 3.

Figure 5:
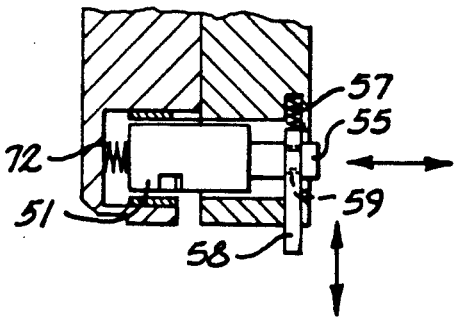
FIG. 5 is a section through the cutting and clamping device of FIG. 3, rotated by 90°.

Upon application of the bobbin support against the drive drum 3, the suction pipe 9 is again returned from the sucking position 9' to the starting position, together with the yarn which has been continuously held by suction (FIG. 2). This swiveling motion causes the yarn to come into the space between the yarn guide 1 and the outlet of suction pipe 9, into the snap ring groove 61 of the assembly 6, which rotates together with the bobbin support or tube, and to finally reach the clamping and cutting device in groove 52 of bolt 51. As soon as the yarn lies in groove 52, bolt 51 is shifted by means of pressure rod 62 in bore 7 and the yarn is cut off by the cutting edge 53 which pushes against the edge 71 of the bore, and is, clamped by the clamping edge 54. For the shifting of 51 to occur at the precise moment when the yarn is in groove 52, the position of the cutting and clamping device 5 is scanned by an initiator (not shown) and the pressure rod 62 is activated by a time switch (not shown) after a period of time dependent upon the circumferential speed of assembly 6. Bolt 51 is prevented from returning into its resting position by a catch in form of a bolt 58 acted upon by a spring 57, so that the yarn remains clamped (FIG. 5). Spring 57 pushes bolt 58 radially outward, causing it to catch in a groove 59 in projection 55 of bolt 51 and to protrude from the assembly 6.

Simultaneously with the clamping of the yarn, the motor 42, which drives the threaded spindle 41, is reversed, so that the displacement means 4 moves back in opposition to the direction indicated by arrow P. At the same time pressure spring 44 pushes the yarn guide 1 in that direction, causing it to bring the yarn back into the bobbin winding zone, after first bringing it back into the radial plane of the yarn reserve formation on bobbin support or tube 2. The yarn reserve is suitably constituted by winding up a length of the clamped yarn onto the reserve winding area on the tube or support outside the bobbin zone. To achieve this, the motor 42 which drives the threaded spindle 41 is reversed.

When the reserve winding has been completed the lifting magnet 64 swivels lever 63 around axis 65 into the position shown in FIG. 4, in which roll 66 pushes bolt 58 back into its resting position, counteracting the force of spring 57. The clamping of the yarn in assembly 6 is thus ended and the yarn guiding fork 8 is swiveled back into its resting position. The displacement means 4 is similarly swivelled away from traverse yarn guide 1 and into its resting position. This swiveling action takes place suitably when the permanent magnet 12, attached to the yarn guiding rod 11, approaches the yarn guide 1. The yarn guide 1, assisted by the returning force of pressure spring 44, couples itself to the permanent magnet 12 and bobbin winding begins again.

What is claimed is:

1. A process for replacing stopped wound yarn bobbins on a winding machine with an empty bobbin support and for transferring a continuously supplied yarn from said stopped yarn bobbins to said empty bobbin support, wherein said yarn is wound onto said bobbins in a bobbin winding zone by a traversing yarn guide, comprising the steps of:

(a) moving said yarn and said yarn traversing guide out of said winding zone into a yarn clamping and cutting zone;

(b) collecting said continuously supplied yarn in said cutting and clamping zone;

(c) severing said yarn between said cutting and clamping zone and said stopped bobbin;

(d) removing said stopped bobbin from said winding machine and replacing it with an empty bobbin support;

(e) cutting and clamping said yarn in said cutting and clamping zone;

(f) moving said yarn and said yarn traversing guide out of said cutting and clamping zone into said bobbing winding zone; and (g) traversing and winding said yarn onto said empty bobbin support.

2. A process as set forth in claim 1, including the step of deflecting said yarn vertically in relation to the axis of the bobbin as said yarn is transferred from said winding zone into said clamping and cutting zone.

3. A process as set forth in claim 1, including the step of collecting said continuously supplied yarn by the use of suction means.

4. A process as set forth in claim 1, including the step of traversing said yarn guide outside of said winding zone to provide a reserve yarn winding onto the end of said bobbin support.

5. A process as set forth in claim 4, including the step of holding said yarn in said clamping and cutting zone until said yarn reserve has been wound.

6. A process as set forth in claim 1, wherein the step of cutting and clamping said yarn immediately follows the replacement of the stopped bobbin.

7. A yarn bobbin winding device having means for replacing full bobbins with empty bobbin supports, comprising:

(a) traverse rod means for traversing a winding zone for winding yarn onto a bobbin support;

(b) a traverse yarn guide detachably connected to said traverse rod means for guiding said yarn onto said bobbin support during the winding of said bobbin;

(c) cutting and clamping means disposed outside of said winding zone for cutting and holding said yarn in a cutting and clamping zone; and (d) means to detach said yarn traverse guide from said traverse rod means and for moving said guide and said yarn into said cutting and clamping zone when said bobbin is completed.

8. A device as set forth in claim 7, wherein said yarn traverse guide is detachably connected to said traverse rod means by a permanent magnet.

9. A device as set forth in claim 8, wherein said means to detach said yarn traverse guide from said traverse rod comprises displacement means disposed on a threaded spindle.

10. A device as set forth in claim 9, wherein said threaded spindle is driven by a reversible motor.

11. A device as set forth in claim 10, wherein said cutting edge and said clamping edge are opposed, one after the other to a counter element surface of the groove within said bore.

12. A device as set forth in claim 7, wherein said permanent magnet is carried by said traverse rod means.

13. A device as set forth in claim 7, further comprising means for moving said traverse yarn guide to wind a reserve of yarn onto said bobbin support in said cutting and clamping zone.

14. A device as set forth in claim 13, wherein said means for traversing said yarn guide in the cutting and clamping zone comprises a spring.

15. A device as set forth in claim 7, wherein said cutting and clamping means comprises a bolt provided with a cutting edge and a clamping edge which define a groove, said cutting edge and said clamping edge being located one behind the other in the yarn running direction, said bolt being disposed within a bore and including means to displace said bolt transversely to the yarn path to interact with an edge of the groove cut into said bore to cut and clamp said yarn.

16. A device as set forth in claim 15, further comprising a suction pipe pivotally mounted for pivoting motion in the radial plane of the snap ring groove and means for pivoting said suction pipe for grasping said yarn and moving said yarn to insert said yarn into said cutting and clamping means.

17. A device as set forth in claim 15, further comprising a yarn deflection means pivotally supported in said cutting and clamping zone for engaging and deflecting said yarn as said traversing yarn guide moves into said cutting and clamping zone to avoid sloughing of yarn from said full bobbin as said yarn is cut and clamped.

18. A device as set forth in claim 15, wherein said cutting and clamping means are incorporated into the means for holding said bobbin support for rotation therewith.

* * * * *